US009470218B2

(12) United States Patent
Eowsakul

(10) Patent No.: US 9,470,218 B2
(45) Date of Patent: Oct. 18, 2016

(54) SELF-COOLING LOOP WITH ELECTRIC RAM FAN FOR MOTOR DRIVEN COMPRESSOR

(71) Applicant: HAMILTON SUNDSTRAND CORPORATION, Windsor Locks, CT (US)

(72) Inventor: Vanwijak Eowsakul, Holyoke, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 430 days.

(21) Appl. No.: 13/889,499

(22) Filed: May 8, 2013

(65) Prior Publication Data

US 2014/0331692 A1 Nov. 13, 2014

(51) Int. Cl.
*F25B 9/00* (2006.01)
*F04B 39/06* (2006.01)

(52) U.S. Cl.
CPC ..... *F04B 39/066* (2013.01)

(58) Field of Classification Search
CPC ..... F25B 9/004; F25B 9/00; F04B 39/06
USPC ..... 62/56, 401, 402, 244
See application file for complete search history.

(56) References Cited

U.S. PATENT DOCUMENTS

| | | | | |
|---|---|---|---|---|
| 5,131,225 | A * | 7/1992 | Roettger | 60/785 |
| 6,928,832 | B2 * | 8/2005 | Lents et al. | 62/401 |
| 6,981,388 | B2 * | 1/2006 | Brutscher et al. | 62/401 |
| 7,342,332 | B2 | 3/2008 | McAuliffe et al. | |
| 7,625,434 | B2 | 12/2009 | Tom et al. | |
| 8,079,407 | B2 * | 12/2011 | Fellague et al. | 165/140 |
| 8,500,878 | B2 * | 8/2013 | Cremers et al. | 96/109 |
| 8,656,912 | B2 * | 2/2014 | Johannessen | 128/204.15 |
| 2004/0261428 | A1 * | 12/2004 | Murry et al. | 62/86 |
| 2005/0151019 | A1 | 7/2005 | Stevens | |
| 2005/0223895 | A1 | 10/2005 | Wong | |
| 2007/0113579 | A1 * | 5/2007 | Claeys et al. | 62/401 |
| 2007/0158122 | A1 * | 7/2007 | Telakowski | 180/68.1 |
| 2008/0060523 | A1 * | 3/2008 | Tom et al. | 96/109 |
| 2008/0110603 | A1 * | 5/2008 | Fellague et al. | 165/140 |
| 2010/0072837 | A1 * | 3/2010 | Telakowski | B64F 1/362 310/59 |

* cited by examiner

*Primary Examiner* — Mohammad M Ali
(74) *Attorney, Agent, or Firm* — Carlson, Gaskey & Olds, PC

(57) ABSTRACT

A motor driven compressor system includes a motor with an internal cooling loop. The internal cooling loop draws cooling air from outside the motor driven compressor system. At least one compressor is driven by the motor. A heat exchanger is in fluid communication with the at least one compressor and the cooling loop and is arranged in a ram air duct. An on board inert gas generating system (OBIGGS) for a gas turbine engine and a method of cooling the system utilizing such a compressor system are also disclosed.

20 Claims, 3 Drawing Sheets

SELF-COOLING LOOP WITH ELECTRIC RAM FAN FOR MOTOR DRIVEN COMPRESSOR

BACKGROUND

This disclosure relates to a motor cooling system for a motor-driven compressor in an aircraft On Board Inert Gas Generating System (OBIGGS).

Aircraft and other vehicles may include an OBIGGS for generating inert gas. An OBIGGS generally includes an air separation module (ASM), which separates air into an inert nitrogen-enriched air (NEA) stream and a permeate oxygen enriched air (OEA) stream. The NEA stream may, for example, be used at the fuel tanks of an aircraft or vehicle.

OBIGGS designs may include a heat exchanger and a motor-driven compressor (MDC) system. The MDC system may include first and second compressors. The heat exchanger may be arranged in a ram-type air duct. During ground operation, cooling airflow over the heat exchanger is usually provided by an ejector downstream of the MDC system, which creates a low pressure area and draws air across the heat exchanger. The ejector air is generated from MDC second compressor outlet. During various flight and day temperatures (i.e., cold to hot day) conditions, the airflow over the heat exchanger may vary. For example, in the hot day condition there may not be enough airflow during ground operations to sufficiently cool the heat exchanger.

Additionally, the MDC is usually cooled by a cooling loop which may pass through an intercooler. Presently, the MDC cooling loop draws air from the outlet of the first compressor, and the air is ultimately discarded overboard after passing through the cooling loop. This lowers the efficiency of the MDC cooling loop during ground operations.

The ASM receives compressed air from the MDC. However, current MDC cooling designs do not effectively provide adequate ASM inlet temperature during cruising. Furthermore, the ejector can lower the flow rate of air available in the MDC system, which in turn decreases the amount of air available for the ASM.

SUMMARY

A motor driven compressor system includes a motor with an internal cooling loop. The internal cooling loop draws cooling air from outside the motor driven compressor system. The compressor system also includes at least one compressor driven by the motor and a heat exchanger in fluid communication with the compressor and the cooling loop. The heat exchanger is arranged in a ram air duct. An on board inert gas generating system (OBIGGS) and a method including the motor driven compressor system are also disclosed.

BRIEF DESCRIPTION OF THE DRAWINGS

The disclosure can be further understood by reference to the following detailed description when considered in connection with the accompanying drawings wherein.

DETAILED DESCRIPTION

Figure 1:
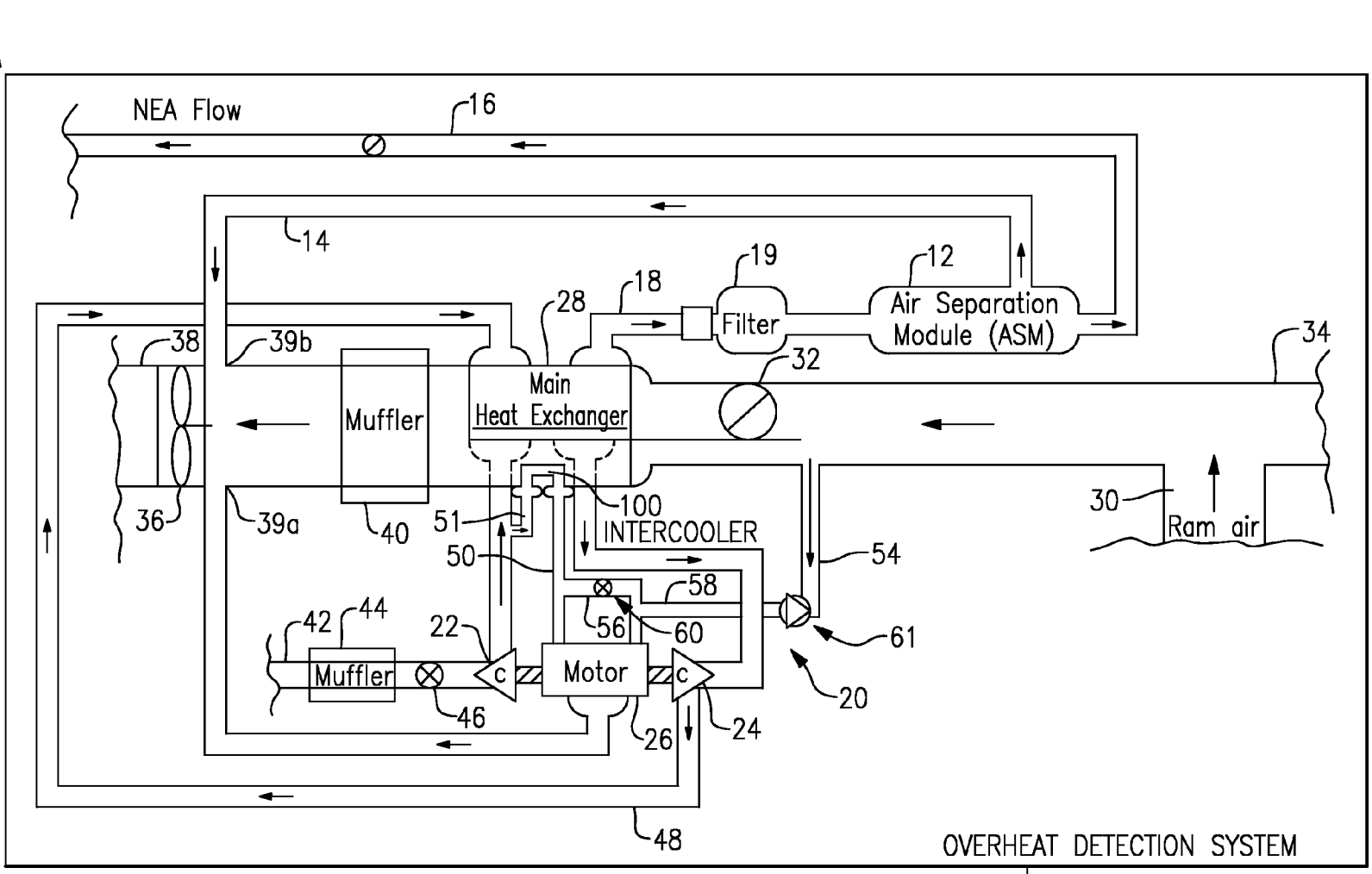
FIG. 1 Prior Art
FIG. 1 schematically illustrates an example prior art ejectorless on board inert gas generating system (OBIGGS) with an electric fan and self-cooling motor driven compressor (MDC).

FIG. 1 shows an example schematic prior art ejectorless On Board Inert Gas Generating System (OBIGGS) 10. The OBIGGS 10 includes an air separation module (ASM) 12. As is known, the air separation module filters air into a permeate (oxygen enriched air, or OEA), which exits the ASM via a conduit 14, and an inert nitrogen-right air (NEA), which exits the ASM via a conduit 16. The ASM 12 receives cool air from a motor-driven compressor (MDC) system 20 via a conduit 18. A filter 19 may filter the air in conduit 18 before it reaches the ASM 12.

The MDC system 20 may include first and second compressors (C) 22 and 24, a motor 26, and a heat exchanger 28. The heat exchanger may be an intercooler-type heat exchanger. That is, cooling fluid and fluid traveling through the MDC system 20 do not mix. The heat exchanger 28 cools air for the ASM 12 and the motor 26. Cooling flow for the heat exchanger 28 is provided by a ram-type duct 30 in one example. Ram air flow may be controlled by a valve 32. Additional cooling air may also be provided by an auxiliary inlet 34 extending through the skin of an associated aircraft. An electric fan 36 is arranged downstream of the heat exchanger 28 in an overboard exhaust 38. A muffler 40 may be arranged downstream of the heat exchanger 28 as well.

The first and second compressors 22, 24 are driven by the motor 26. Air enters the MDC system 20 from an inlet 42. This air may be from a cabin or cargo compartment of an aircraft. A second muffler 44 and/or a valve 46 may be arranged downstream of the MDC inlet 42. Air is compressed by the first compressor 22 and sent to the heat exchanger 28. Air from the heat exchanger 28 goes to the second compressor 24. The flow passages for the system air within the heat exchanger 28 are not shown but would be apparent to a worker in the art. Air from the second compressor 24 cycles back to the heat exchanger 28 by the return line 48. Air from line 48 enters the heat exchanger 28 to become temperature conditioned air 18 that feeds into the filter 19. Air exiting from the motor 26 and permeate exiting from the ASM 12 via conduit 14 may feed into the overboard exhaust 38 at mixing points 39*a* and 39*b*, respectively. In the example shown in FIG. 1, both mixing points 39*a*, 39*b* are upstream from the electric fan 36.

The MDC system 20 includes a cooling loop 50. Hot compressed air from the first compressor 22 is pushed through an intercooler 100 via a conduit 51. The intercooler 100 feeds into the motor 26 for direct stator cooling. The hot compressed air is cooled by the heat exchanger 28 in the intercooler 100 and used to cool the motor 26. During flight, valve 60 is closed. The cooling ram air may then be used to cool the motor 26 via conduit 54. During ground operations, bearing and rotor cooling is provided by the stream 56 while check valve 61 is closed.

Figure 2:
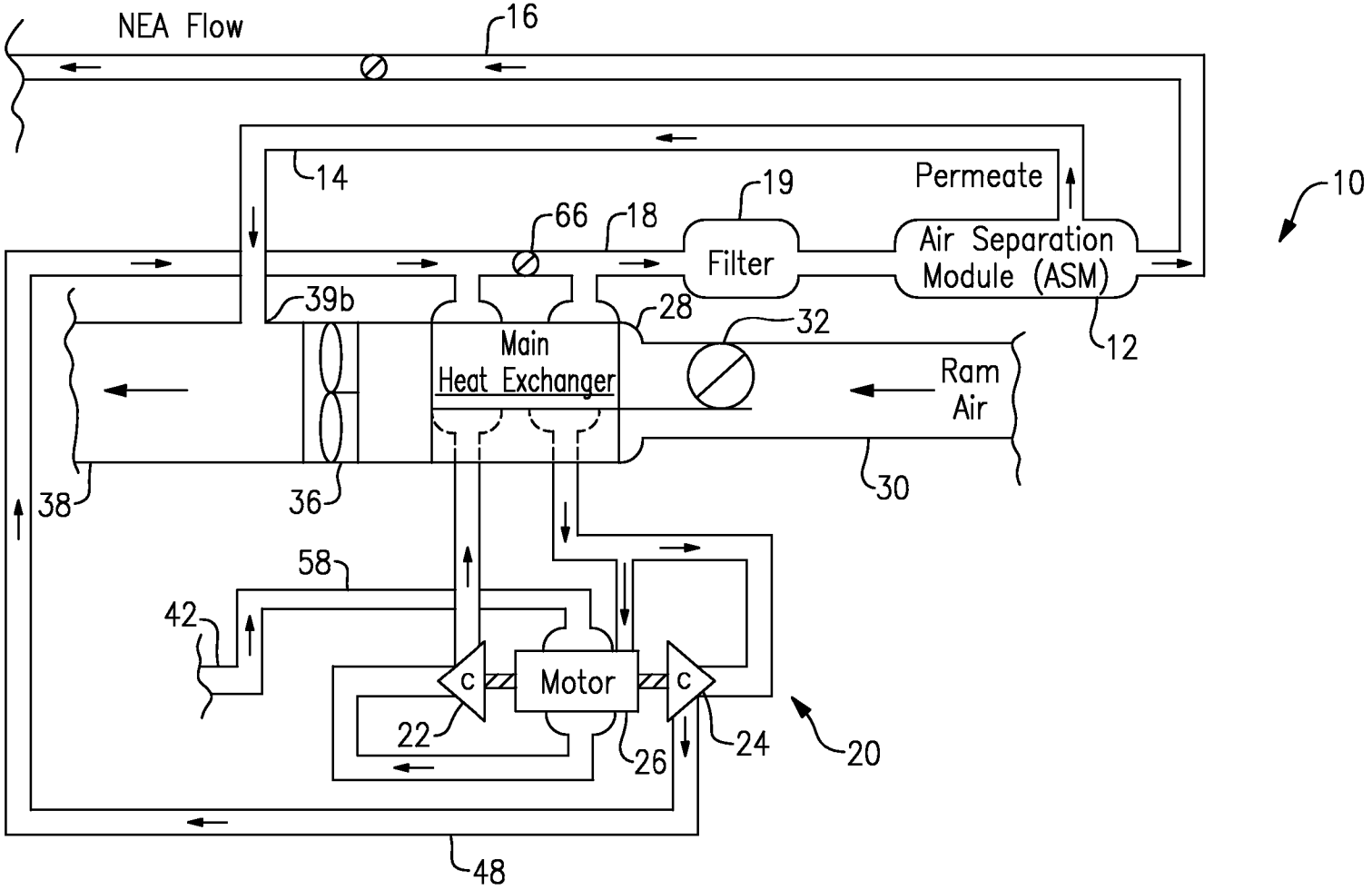
FIG.2 Prior Art
FIG. 2 schematically illustrates an alternate prior art OBIGGS with an electric fan and self-cooling MDC.

Referring to FIG. 2, an alternate prior art OBIGGS 10 is schematically shown. In the alternate OBIGGS 10, the mixing point 39*b* is downstream from the electric fan 36. In this example, some air exiting from the second compressor 24 in the return line 48 may pass directly to the ASM 12 via conduit 18.

The OBIGGS 10 may also include a temperature detection or regulation system. For example, in FIG. 1 the OBIGGS 10 includes an overheat detection system 64 integrated into the OBIGGS to ensure that the system components, for example, the first and second compressors 22, 24, do not exceed a predetermined threshold temperature which may affect operation of the MDC system 20. In FIG. 2, a temperature regulator valve 66 is arranged near the heat exchanger feed to ensure that air entering the ASM 12 is at an appropriate temperature.

Figure 3:
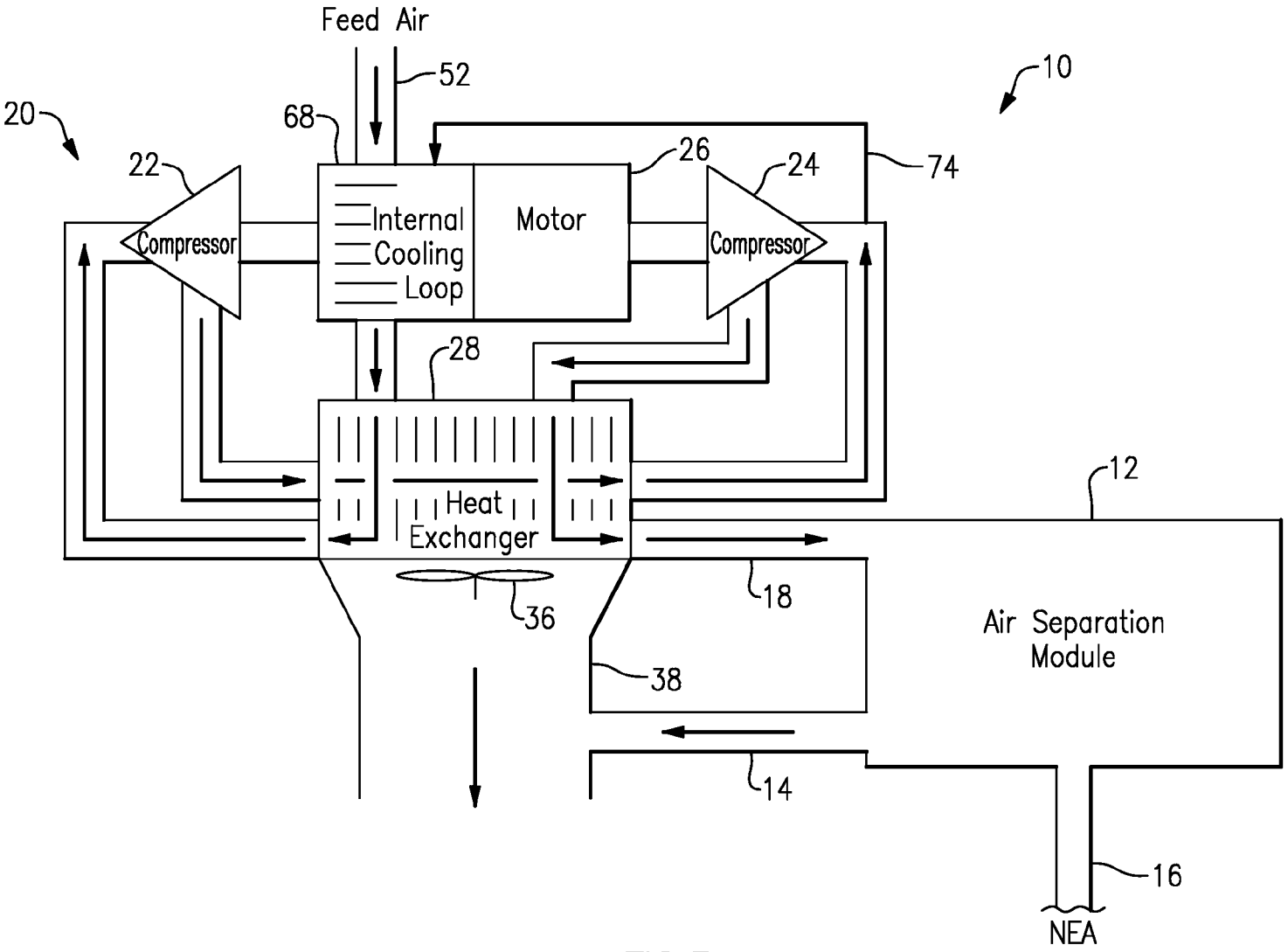
FIG. 3 schematically illustrates an alternate detail self-cooling MDC.

FIG. 3 shows a detail arrangement for the MDC system 20. The MDC system 20 has an internal cooling loop 68. The internal cooling loop 68 draws cooling air from the intake 52 external to the OBIGGS 10. The cooling air passes though the internal cooling loop 68 and then may be cooled by the heat exchanger 28. Additionally, a bearing and rotor cooling loop 74 may draw air from the heat exchanger 28 outlet and may feed into the internal cooling loop 68.

Although example embodiments have been disclosed, a worker of ordinary skill in this art would recognize that certain modifications would come within the scope of the claims. For that and other reasons, the following claims should be studied to determine their true scope and content.

What is claimed is:

1. A motor driven compressor system for use in an on board inert gas generating system (OBIGGS), comprising:
- a motor including an internal cooling loop, wherein the internal cooling loop draws cooling air from outside the motor driven compressor system;
- at least one compressor driven by the motor; and
- a heat exchanger in fluid communication with the at least one compressor and the cooling loop and arranged in a ram air duct; and
- a fan arranged downstream from the heat exchanger in the ram air duct.

2. The motor driven compressor system of claim 1, wherein the at least one compressor comprises a first compressor and a second compressor.

3. The motor driven compressor system of claim 1, wherein the fan is an electric fan.

4. The motor driven compressor system of claim 1, wherein the ram air duct feeds into an overboard exhaust downstream from the fan.

5. The motor driven compressor system of claim 1, wherein the heat exchanger is an intercooler-type heat exchanger.

6. The motor driven compressor system of claim 1, further comprising a bearing and rotor cooling loop separate from the internal cooling loop.

7. The motor driven compressor system of claim 6, wherein the bearing and rotor cooling loop draws cooling air from an outlet of the heat exchanger.

8. The motor driven compressor system of claim 6, wherein the bearing and rotor cooling loop feeds into the internal cooling loop.

9. The motor driven compressor system of claim 1, further comprising an air separation module (ASM) configured to separate nitrogen-enriched air from oxygen-enriched air and in fluid communication with the heat exchanger.

10. An on board inert gas generating system (OBIGGS) for a gas turbine engine, comprising:
- an air separation module (ASM) configured to separate nitrogen-enriched air from oxygen-enriched air;
- a heat exchanger configured to cool air entering the ASM and arranged in a ram air duct; and
- a motor driven compressor system feeding air into the ASM, and including a first compressor and a second compressor driven by a motor and an internal cooling loop, wherein the internal cooling loop draws cooling air from outside the OBIGGS, wherein air from the first compressor feeds into an overboard exhaust at a first mixing point and oxygen-enriched air feeds into the overboard exhaust at a second mixing point.

11. The OBIGGS of claim 10, wherein a fan is arranged downstream from the heat exchanger and upstream from the overboard exhaust in the ram air duct.

12. The OBIGGS of claim 11, wherein the second mixing points is downstream from the fan.

13. The OBIGGS of claim 11, wherein the first and second mixing points are upstream from the fan.

14. The OBIGGS of claim 10, wherein air exiting from the internal cooling loop is cooled by the heat exchanger.

15. The OBIGGS of claim 10, further comprising a temperature regulator valve between the heat exchanger and the ASM.

16. A method of cooling an on board inert gas generating system (OBIGGS), comprising:
- providing a motor driving at least one compressor;
- providing a heat exchanger arranged in a ram air duct and configured to cool air passing to an air separation module (ASM) from the at least one compressor;
- providing a fan arranged downstream from the heat exchanger in the ram air duct;
- drawing cooling air from outside of the OBIGGS; and
- providing the cooling air to a motor cooling loop.

17. The method of claim 16, further comprising passing air exiting the cooling loop through the heat exchanger.

18. The method of claim 16, further comprising drawing additional cooling air from an outlet of the heat exchanger and providing the additional cooling air to a bearing and rotor cooling loop.

19. The method of claim 18, further comprising passing air exiting from the bearing and rotor cooling loop to the motor cooling loop.

20. The method of claim 16, further comprising regulating a temperature of the air passing to the ASM from the at least one compressor.

* * * * *